US009799429B2

(12) United States Patent
Adams

(10) Patent No.: US 9,799,429 B2
(45) Date of Patent: Oct. 24, 2017

(54) COAXIAL CABLE WITH DIELECTRIC LAYER HAVING SEALED SEGMENTS AND METHOD OF MAKING SAME

(71) Applicant: CommScope Technologies LLC, Hickory, NC (US)

(72) Inventor: Scott M. Adams, Catawba, NC (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/272,756

(22) Filed: Sep. 22, 2016

(65) Prior Publication Data

US 2017/0098493 A1 Apr. 6, 2017

Related U.S. Application Data

(60) Provisional application No. 62/237,954, filed on Oct. 6, 2015.

(51) Int. Cl.
*H01B 11/18* (2006.01)
*H01B 13/00* (2006.01)
*H01B 13/016* (2006.01)

(52) U.S. Cl.
CPC ..... *H01B 11/1834* (2013.01); *H01B 13/0009* (2013.01); *H01B 13/016* (2013.01)

(58) Field of Classification Search
CPC ..... H01B 11/1834; H01B 13/0009; H01B 13/016; H01B 11/1804; H01B 11/1808; H01B 11/20
USPC ..... 174/28, 121 A, 107, 102 D, 29, 30, 27, 174/108, 12 R
See application file for complete search history.

(56) References Cited

U.S. PATENT DOCUMENTS 4,667,061 A * 5/1987 Ishikawa ..... H02G 5/063 174/28
4,758,685 A * 7/1988 Pote ..... H01B 11/1843 174/28
4,780,695 A * 10/1988 Watari ..... H01Q 13/203 174/121 A
5,262,593 A * 11/1993 Madry ..... H01B 11/1856 174/29

(Continued)

FOREIGN PATENT DOCUMENTS

KR 10-2007-0087347 A 8/2007
KR 10-2012-0088312 A 8/2012
WO WO 2010-003215 A 1/2010

OTHER PUBLICATIONS

Notification of Transmittal of the International Search Report and the Written Opinion of the International Searching Authority, International Application No. PCT/US2016/052606; Date of Mailing: Dec. 28, 2016; 10 Pages.

*Primary Examiner* — Angel R Estrada
(74) *Attorney, Agent, or Firm* — Myers Bigel, P.A.

(57) ABSTRACT

A coaxial cable includes: a center conductor; a dielectric layer circumferentially surrounding the center conductor; and an outer conductor circumferentially surrounding the dielectric layer. The dielectric layer comprises an inner sleeve that circumferentially overlies the center conductor and an outer sleeve that circumferentially overlies the inner conductor. The outer sleeve contacts the inner sleeve to form a plurality of longitudinally-spaced seams to create a plurality of sealed segments along a longitudinal axis of the cable.

19 Claims, 2 Drawing Sheets

(56) References Cited

U.S. PATENT DOCUMENTS

| | | | | |
|---|---|---|---|---|
| 5,742,002 | A * | 4/1998 | Arredondo | H01B 11/1847 174/29 |
| 7,361,831 | B2 * | 4/2008 | Tanaka | H01B 11/1804 174/28 |
| 7,642,451 | B2 * | 1/2010 | Bonn | H01B 11/1856 174/28 |
| 8,779,293 | B2 * | 7/2014 | Cho | H01B 11/1878 174/102 D |
| 8,816,207 | B2 * | 8/2014 | Abe | H01B 11/1817 174/107 |
| 8,933,330 | B2 * | 1/2015 | Hayashishita | H01B 11/1895 174/28 |
| 2001/0032731 | A1 | 10/2001 | Badii et al. | |
| 2010/0212926 | A1 | 8/2010 | Cho et al. | |

* cited by examiner

COAXIAL CABLE WITH DIELECTRIC LAYER HAVING SEALED SEGMENTS AND METHOD OF MAKING SAME

RELATED APPLICATION

The present application claims priority from and the benefit of U.S. Provisional Patent Application No. 62/237,954, filed Oct. 6, 2015, the disclosure of which is hereby incorporated herein in its entirety.

FIELD OF THE INVENTION

The present invention relates generally to cable, and more particularly to coaxial cable.

BACKGROUND

Coaxial cable typically includes an inner conductor, an outer conductor, a dielectric layer that separates the inner and outer conductors, and a jacket that surrounds the outer conductor. The outer conductor can take many forms, including flat, braided, and corrugated.

The dielectric layer is typically formed of a foamed polymeric material. However, in some instances attempts to increase the degree of air present in the dielectric layer have been made, as reduced material/increased air in the dielectric layer can reduce signal loss and/or increase the velocity of propagation of the signal. These approaches have some disadvantages, though, such as the inability to block the longitudinal migration of ingressed water, high material cost, poor reliability in the field, and slow manufacturing speed. For example, a prior coaxial cable 10 illustrated in FIG. 1 includes a continuous spiraling fin of solid polyethylene that serves as the dielectric layer 14 around a center conductor 12. An outer conductor 16 overlies the dielectric layer 14, and a polymeric jacket 18 overlies the outer conductor 16. In addition to being slow to manufacture, this design is incapable of blocking longitudinal migration of ingressed water. As another example, FIG. 2 illustrates a prior cable 10' in which a center conductor 12' is held at the center longitudinal axis by an array of surrounding PTFE tubes 14' that serve as the dielectric layer, with an outer conductor 16' and a jacket 18' surrounding the tubes 14'. This design is also incapable of blocking ingressed water, and further has shown to be unreliable during heavy bending in the field; this unreliability is due to mechanical bending forces that cause the center conductor 12' to displace an adjacent tube 14', thus creating an electrical short between the inner and outer conductors. A similar design that employs "spokes" to maintain the center conductor in place also fails to block ingressed water. FIG. 3 illustrates a cable 10" (discussed in U.S. Pat. No. 2,992,407 to Slusher, the disclosure of which is hereby incorporated by reference herein in its entirety) employing solid discs 14" spaced along the center conductor 12", with an outer conductor 16" and a jacket 18" completing the cable 10". This design is capable of blocking water, but is relatively slow to manufacture, as the discs are individually injection-molded and positioned subsequently on the center conductor 12". The solid discs 14", typically formed of polyethylene, also contain significant mass to slow the velocity of propagation and degrade the electrical properties of the cable.

In view of the foregoing, it may be desirable to provide additional designs of dielectric layers utilizing air in the dielectric layer.

SUMMARY

As a first aspect, embodiments of the invention are directed to a coaxial cable, comprising: a center conductor; a dielectric layer circumferentially surrounding the center conductor; and an outer conductor circumferentially surrounding the dielectric layer. The dielectric layer comprises an inner sleeve that circumferentially overlies the center conductor and an outer sleeve that circumferentially overlies the inner conductor. The outer sleeve contacts the inner sleeve to form a plurality of longitudinally-spaced seams to create a plurality of sealed segments along a longitudinal axis of the cable.

As a second aspect, embodiments of the invention are directed to a coaxial cable, comprising: a center conductor; a dielectric layer circumferentially surrounding the center conductor; and an outer conductor circumferentially surrounding the dielectric layer. The dielectric layer comprises an inner sleeve that circumferentially overlies the center conductor and an outer sleeve that circumferentially overlies the inner conductor. The outer sleeve includes a series of alternating crests and roots, the roots contacting the inner sleeve to create a plurality of sealed segments along a longitudinal axis of the cable.

As a third aspect, embodiments of the invention are directed to a method of manufacturing a coaxial cable, comprising the steps of: (a) advancing a central conductor and an inner sleeve of a dielectric layer along a longitudinal axis; (b) extruding an outer sleeve of the dielectric layer to circumferentially surround the inner sleeve, the outer sleeve being spaced radially from the inner sleeve; and (c) intermittently directing portions of the outer sleeve into contact with the inner sleeve to form segments along the longitudinal axis, each segment being sealed from immediately adjacent segments, the segments comprising the dielectric layer.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
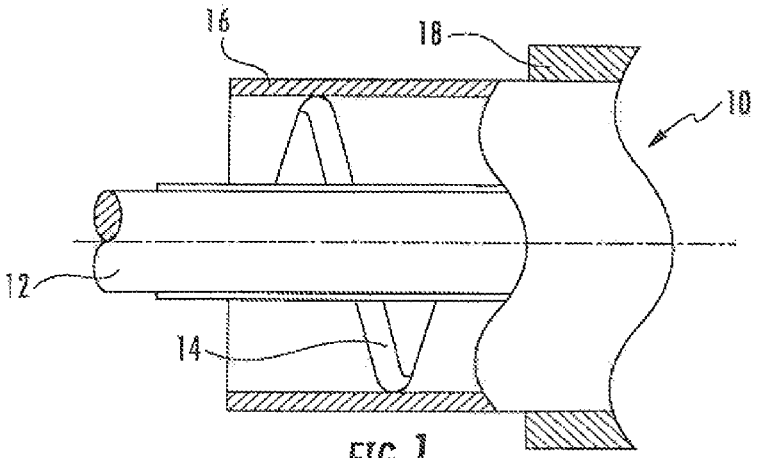
FIG. 1 PRIOR ART
FIG. 1 is a front section view of a prior coaxial cable.
Figure 2:
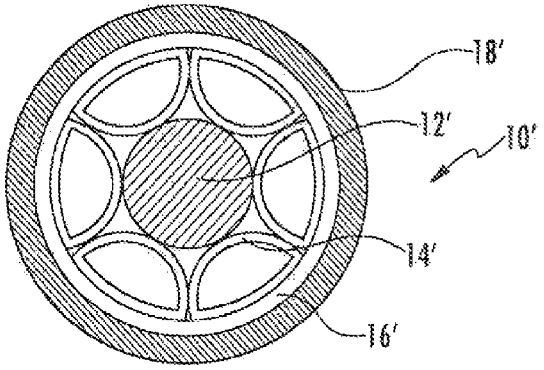
FIG. 2 PRIOR ART
FIG. 2 is an end section view of another prior coaxial cable.
Figure 3:
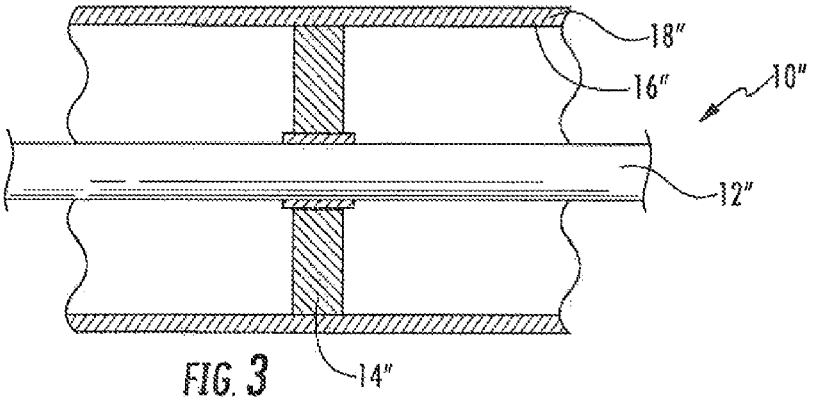
FIG. 3 PRIOR ART
FIG. 3 is a front section view of still another prior coaxial cable.
Figure 4:
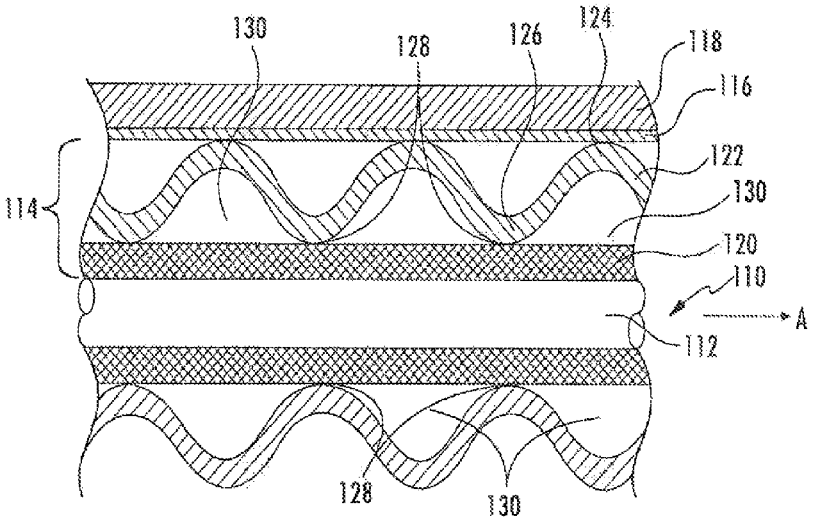
FIG. 4 is a front section view of a portion of a coaxial cable according to embodiments of the invention.

Referring now to FIG. 4, a portion of a coaxial cable, designated broadly at 110, is shown therein. The cable 110 includes a center conductor 112, an outer conductor 116, and a jacket 118, each of which may be of conventional construction; for example, the outer conductor 116 may be smooth-walled as shown, or may alternatively be corrugated, braided, or the like. A longitudinal axis A extends through the center conductor 112.

A dielectric layer 114 is interposed between the center conductor 112 and the outer conductor 116. The dielectric layer 114 includes an inner sleeve 120 and an outer sleeve 122. As can be seen in FIG. 4, the inner sleeve 122 circumferentially overlies the center conductor 112. The outer sleeve 122 circumferentially overlies the inner sleeve 120 and is corrugated or scalloped, with alternating radially-outward crests 124 and radially-inward roots 126. The roots 126 of the outer sleeve 122 contact and are attached to the inner sleeve 120 at a plurality of generally evenly longitudinally-spaced seams 128. The result is a series of individual inflated segments or compartments 130 that are separated from each other, with the seams 128 sealing adjacent segments 130 from each other to prevent the escape of gas (e.g., air) from the segments 130.

The inner sleeve 120 and outer sleeve 122 may be formed of any dielectric material, with a polyolefin or other polymeric material being typical. In some embodiments, either or both of the inner sleeve 120 and outer sleeve 122 may include EAA or another filler to promote tackiness/adhesion. Both the inner sleeve 120 and the outer sleeve 122 may be relatively thin; the thickness of the inner sleeve 120 may be between about 0.002 and 0.030 inch, and the thickness of the outer sleeve 122 may be between about 0.002 and 0.030 inch. The segments 130 may be between about 0.375 and 12 inches in length (i.e., between adjacent seams 128) and between about 0.250 and 4 inches in height (i.e., between the crests 124 and the roots 126). In some embodiments, the inner sleeve 120 comprises a coating applied to the center conductor 112.

Figure 5:
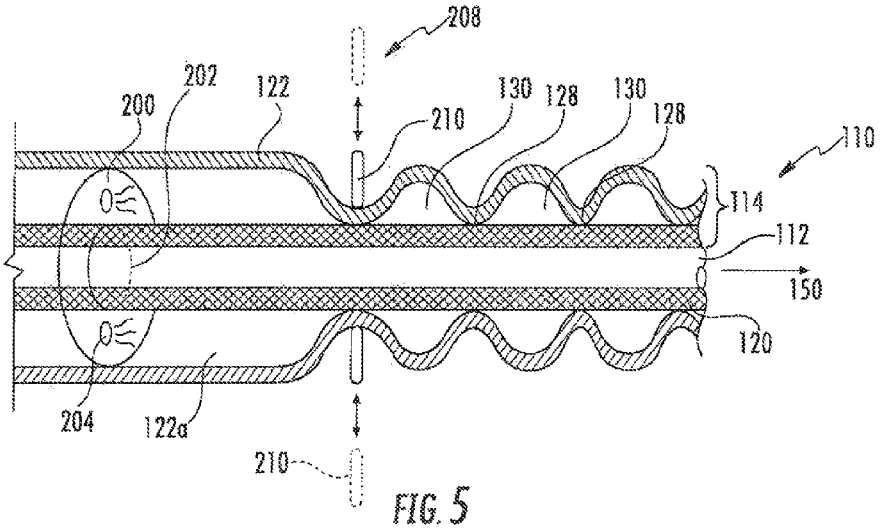
FIG. 5 is a front section view of the center conductor and the dielectric layer of the coaxial cable of FIG. 4 with a manufacturing technique illustrated schematically.

Referring now to FIG. 5, an exemplary manufacturing technique for the cable 110 is illustrated therein. The center conductor 112 with the inner sleeve 120 applied thereon is advanced along the longitudinal axis A as shown by the arrow 150. The outer sleeve 122 is extruded in a molten state through the circular aperture of an annular die 200. The annular die 200 has a central opening 202 through which the center conductor 112 and inner sleeve 114 pass. The annular die 200 may also optionally have openings 204 through which pressurizing gas may be pumped in. Exemplary pressurizing gases include (but are not limited to) air, nitrogen, and carbon dioxide.

Upon exiting the annular die 200, the outer sleeve 122 is in the form of a tube that is spaced radially from the inner sleeve 120. The tube is maintained in an inflated state by pressurizing the lumen 122*a* with the pressurizing gas exiting the openings 204. Those skilled in the art will recognize that there are numerous techniques suitable for expanding and stretching the tube to achieve the desired thickness and properties.

The tube is advanced to a station 208 that includes an encircling compression tool 210. The encircling compression tool 210 may, for example, comprise a mechanical iris capable of closing and opening per a controlled pattern. The encircling compression tool 210 moves radially inwardly toward the center conductor 112, thereby drawing a section of the tube radially inwardly to contact with the inner sleeve 120. Because the two sleeves 120, 122 are tacky, they adhere upon contact and form a gas-tight seal 128 surrounding the circumference of the inner sleeve 120. The compression tool 210 then retracts to a non-contact position (shown in phantom line and designated 210'). The center conductor 112 and dielectric layer 114 are advanced forward, and the compression tool 210 is cycled over time to repeat the pattern. The outer conductor 116 and jacket 118 can then be added in a conventional manner.

Notably, the presence of the largely-empty the segments 130 provides a dielectric layer that is predominantly air (or another gas), which as described above can improve electrical properties. In addition, the presence of the seams 128 to provide a seal between adjacent segments 130 can prevent the ingress of moisture along the cable. Moreover, by including a reduced amount of material in the dielectric layer (as compared to a foamed dielectric layer), the cable is more likely to be capable of passing smoke and/or fire tests (e.g., NFPA-262), and thus may be rated for use in environments (such as plenums) in which cables with foamed or solid dielectric layers could not.

Those of skill in this art will appreciate that the cable may take other forms than those illustrated herein and/or discussed above. For example, the segments 130 may be longer or shorter than discussed above. The inner sleeve 120 may be applied at the same time as the outer sleeve 122. The compression tool 210 may be configured to form multiple segments in a single compression action, and/or may be configured to form segments having a different shape (e.g., triangular). Alternatively, multiple compression tools 210 may act at the same time to improve through-put.

As an alternative, the inner sleeve may be corrugated or scalloped in the manner described above for the outer sleeve, with the outer sleeve also being scalloped or corrugated, or with the outer sleeve being smooth.

In another embodiment, the dielectric layer may be formed of a pre-manufactured length of dielectric material provided in strips which already contain inflated gas pockets. These strips may be wrapped around an advancing center conductor and secured in place via application of the outer conductor 116.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial cable, comprising:

a center conductor;

a dielectric layer circumferentially surrounding the center conductor; and an outer conductor circumferentially surrounding the dielectric layer;

wherein the dielectric layer comprises an inner sleeve that circumferentially overlies the center conductor and an outer sleeve that circumferentially overlies the inner sleeve, wherein the outer sleeve contacts the inner sleeve to form a plurality of longitudinally-spaced seams to create a plurality of sealed segments along a longitudinal axis of the cable.

2. The coaxial cable defined in claim 1, wherein the inner sleeve comprises a coating applied to the center conductor.

3. The coaxial cable defined in claim 1, wherein the inner sleeve has a thickness of between about 0.002 and 0.030 inch.

4. The coaxial cable defined in claim 1, wherein the outer sleeve has a thickness of between about 0.002 and 0.030 inch.

5. The coaxial cable defined in claim 1, wherein the seams are circumferential seams.

6. The coaxial cable defined in claim 1, wherein the seams are generally evenly spaced along the length of the cable.

7. The coaxial cable defined in claim 1, wherein the segments have a length of between about 0.375 and 12 inches.

8. The coaxial cable defined in claim 1, wherein the segments are filled with a gas.

9. A coaxial cable, comprising:

a center conductor, a dielectric layer circumferentially surrounding the center conductor; and an outer conductor circumferentially surrounding the dielectric layer;

wherein the dielectric layer comprises an inner sleeve that circumferentially overlies the center conductor and an outer sleeve that circumferentially overlies the inner sleeve, wherein the outer sleeve includes a series of alternating crests and roots, the roots contacting the inner sleeve to create a plurality of sealed segments along a longitudinal axis of the cable.

10. A method of manufacturing a coaxial cable, comprising the steps of:

(a) advancing a central conductor and an inner sleeve of a dielectric layer along a longitudinal axis;

(b) extruding an outer sleeve of the dielectric layer to circumferentially surround the inner sleeve, the outer sleeve being spaced radially from the inner sleeve; and (c) intermittently directing portions of the outer sleeve into contact with the inner sleeve to form segments along the longitudinal axis, each segment being sealed from immediately adjacent segments, the segments comprising the dielectric layer.

11. The method defined in claim 10, further comprising the step of introducing gas within the outer sleeve prior to step (c) to maintain spacing between the inner and outer sleeves.

12. The method defined in claim 11, wherein step (b) is performed with a annular die, and wherein gas is introduced within the outer sleeve via the annular die.

13. The method defined in claim 10, wherein step (c) is performed with a compressing tool.

14. The method defined in claim 10, wherein the inner sleeve comprises a coating applied to the center conductor.

15. The method defined in claim 10, wherein the inner sleeve has a thickness of between about 0.002 and 0.030 inch.

16. The method defined in claim 10, wherein the outer sleeve has a thickness of between about 0.002 and 0.030 inch.

17. The method defined in claim 10, wherein the seams are circumferential seams.

18. The method defined in claim 10, wherein the segments are generally evenly spaced along the length of the cable.

19. The method defined in claim 10, wherein the segments have a length of between about 0.375 and 12 inches.

* * * * *